US010640988B2

(12) United States Patent
Bitsch

(10) Patent No.: US 10,640,988 B2
(45) Date of Patent: May 5, 2020

(54) LAMELLA FACADE SYSTEM AND USE THEREOF

(71) Applicant: NORDISK PROFIL A/S, Copenhagen K (DK)

(72) Inventor: John Bitsch, Klampenborg (DK)

(73) Assignee: NORDISK PROFIL A/S, Copenhagen K (DK)

( * ) Notice: Subject to any disclaimer, the term of this patent is extended or adjusted under 35 U.S.C. 154(b) by 0 days.

(21) Appl. No.: 16/096,460

(22) PCT Filed: Apr. 25, 2017

(86) PCT No.: PCT/EP2017/059753
§ 371 (c)(1),
(2) Date: Oct. 25, 2018

(87) PCT Pub. No.: WO2017/186694
PCT Pub. Date: Nov. 2, 2017

(65) Prior Publication Data

US 2019/0119926 A1 Apr. 25, 2019

(30) Foreign Application Priority Data

Apr. 26, 2016 (EP) ..... 16167154

(51) Int. Cl.
*E04F 13/08* (2006.01)
*E04F 13/10* (2006.01)
*E04F 10/08* (2006.01)

(52) U.S. Cl.
CPC ..... *E04F 13/0819* (2013.01); *E04F 10/08* (2013.01); *E04F 13/0814* (2013.01); *E04F 13/10* (2013.01)

(58) Field of Classification Search
CPC ..... E04F 13/0801; E04F 13/0803; E04F 13/0819; E04F 13/0816; E04F 13/10; E04F 13/08
See application file for complete search history.

(56) References Cited

U.S. PATENT DOCUMENTS 2,042,290 A * 5/1936 Barrett ..... E04F 13/0803 52/415
4,516,373 A * 5/1985 Osawa ..... E04F 13/0805 52/387

(Continued)

FOREIGN PATENT DOCUMENTS

BE 1 020 429 10/2013
DE 102005019977 A1 * 11/2006 ..... E04F 13/0805

(Continued)

OTHER PUBLICATIONS

International Search Report and Written Opinion of the ISA for PCT/EP2017/059753, dated Jul. 11, 2017, 14 pages.

(Continued)

*Primary Examiner* — Christine T Cajilig
(74) *Attorney, Agent, or Firm* — Nixon & Vanderhye P.C.

(57) ABSTRACT

The present invention relates to a lamella front surface system (1), comprising at least one lamella (2), at least two metal mounting elements (3) each having a mounting axis, configured to be attached to a support (4), e.g. the face of a building, each of the metal mounting elements comprising mounting side (6) abutting the face in its mounted position, an interfacing side (7) arranged opposite the mounting side, the interfacing side comprising attachment means (8), wherein the lamella front surface system further comprises a fixation element (5) having a longitudinal extension (FA) and having a body (9) having a first side (10) comprising interfacing means (12, 13) configured to be connected with the attachment means, and a second side (11) configured to (Continued)

support the lamella in a position which is substantially perpendicular to the mounting axis of the metal mounting elements, and wherein the lamella is made from a non-metal material. The present invention also relates to use of the lamella front surface system according to the present invention.

16 Claims, 17 Drawing Sheets

(56) References Cited

U.S. PATENT DOCUMENTS

| | | | | |
|---|---|---|---|---|
| 4,635,424 | A * | 1/1987 | Drapeau | E04B 9/24 52/480 |
| 6,430,885 | B1 * | 8/2002 | Ito | E04F 13/0812 52/235 |
| 2017/0089075 | A1 * | 3/2017 | Napier | E04F 13/081 |
| 2019/0055737 | A1 * | 2/2019 | Aboukhalil | E04F 13/0803 |

FOREIGN PATENT DOCUMENTS

| | | | | |
|---|---|---|---|---|
| EP | 0685614 | A1 * | 12/1995 | E04F 13/0825 |
| EP | 2 278 090 | | 1/2011 | |
| JP | 5-83289 | | 11/1993 | |
| JP | 10-0668113 | | 1/2007 | |
| WO | WO-2008127207 | A2 * | 10/2008 | E04F 13/0819 |
| WO | 2012/035563 | | 3/2012 | |
| WO | 2014/068551 | | 5/2014 | |
| WO | WO-2015150616 | A1 * | 10/2015 | E04F 13/0812 |
| WO | WO-2017026581 | A1 * | 2/2017 | E04F 13/08 |

OTHER PUBLICATIONS

Extended Search Report for EP16167154.0, dated Nov. 3, 2016, 11 pages.

* cited by examiner

LAMELLA FACADE SYSTEM AND USE THEREOF

This application is the U.S. national phase of International Application No. PCT/EP2017/059753 filed 25 Apr. 2017, which designated the U.S. and claims priority to EP Patent Application No. 16167154.0 filed 26 Apr. 2016, the entire contents of each of which are hereby incorporated by reference.

FIELD OF THE INVENTION

The present invention relates to a lamella front surface system and to use of such lamella front surface system.

BACKGROUND ART

A number of systems exist for creating a finish of a front surface of a structure, the exterior finish being lamella, jalousies, louvres, blinds or similar and the interior being tapestry or thin wooden boards. Creating such finishing face of a structure, e.g. a building, is often a cumbersome and time-consuming process. When creating a wood finishing face of a structure, the wood is attached directly to the structure by screws or similar. This implies handling long elements and machinery during the actual front surface installation process of e.g. a facade, roof, wall or a ceiling. If a single board or a single wood part gets deteriorated or otherwise damaged, it is extremely expensive to repair such individual part and involves a great risk of damaging the neighbouring parts.

SUMMARY ON THE INVENTION

It is an object of the present invention to wholly or partly overcome the above disadvantages and drawbacks of the prior art. More specifically, it is an object to provide an improved lamella front surface system having a non-metal face and in which it is easy to install and uninstall individual elements.

The above objects, together with numerous other objects, advantages, and features, which will become evident from the below description, are accomplished by a solution in accordance with the present invention by a lamella front surface system, comprising:

- at least one lamella,
- at least two metal mounting elements each having a mounting axis, configured to be attached to a support, e.g. the face of a building, each of the metal mounting elements comprising:

- a mounting side abutting the face in its mounted position,
- an interfacing side arranged opposite the mounting side, the interfacing side comprising attachment means, wherein the lamella front surface system further comprises:

- a fixation element having a longitudinal extension and having:
- a body having a first side comprising interfacing means configured to be connected with the attachment means, and
- a second side configured to support the lamella in a position which is substantially perpendicular to the mounting axis of the metal mounting elements, and wherein the lamella is made from a non-metal material.

In this way it is achieved that the mounting process of non-metal lamellae is carried out without tools and at a much higher pace and with a greater degree of precision than hitherto known. The lamellae are the visible part and hence it is highly important to the quality of the final installation that the lamellae are precisely mounted. Furthermore, when no fixation is carried out from the front of the lamella, e.g. by means of screws or nails, the risk of introducing rot or fungus to the lamella is avoided.

The interfacing means of the first side of the fixation element may comprise at least a first projecting leg projecting from the body of the fixation element, the first projecting leg being configured to connect with the attachment means of the metal mounting element.

Furthermore, an end part of the at least one first projection leg may comprise an area of increased thickness.

Moreover, an end part of a first or a second projection leg may comprise an area of increased thickness.

Also, the attachment means of the metal mounting element may be a separate part affixed to the metal mounting element.

Furthermore, the attachment means may comprise two projecting attachment arms for engaging with two projecting legs of the fixation element.

In addition, the attachment means may be a number of slots arranged in the interface side, the slots being configured to receive a first projecting leg of the fixation element.

The end part of the first projecting leg and a slot of the attachment means constitutes a snap-lock arrangement.

Moreover, the end part of a projecting leg and a slot of the attachment means may constitute a snap-lock arrangement.

The first side of the fixation element may comprise a second projecting leg having an end part, the end part of the second projecting leg being in a substantially perpendicular position configured to be lockingly engaged with the attachment means of the metal mounting element.

Further, the fixation means may extend substantially along the full length of the longitudinal extension of the non-metal lamella.

Also, the lamella may be made of wood, wood fibre composites, glass or composites such as compact rock or compact marble.

Additionally, the longitudinal extension of the lamella may be different from a length of the fixation element.

In one embodiment, the fixation element may be made of metal.

Moreover, the longitudinal extension of the lamella may be more than 5 mm longer than the longitudinal extension of the fixation element.

The longitudinal extension of the lamella may be longer than the longitudinal extension of the fixation element by 10-100 mm or more.

Furthermore, the fixation element may be 890-990 mm and the lamella may be 990-1010 mm.

Also, the metal mounting element may have a surface, the surface being treated e.g. by eloxation, anodization or painted.

Further, when inserting the end part of the first projection leg from a position in which the first projecting leg, and thereby the fixation element as a whole, may be tilted by more than 5° and less than 80° from perpendicular to the mounting element, the end part of the first projecting leg of the fixation element may be inserted into the attachment means of the mounting element substantially without touching each other, and upon tilting to a position different from approximately 5°-80°, they may be are arranged to be lockingly engaged.

Both the first projecting leg and the second projecting leg may comprise an end part having an increased thickness.

Additionally, the fixation element may comprise at least one alignment projection extending from the side of the body opposite the side from which the at least one first projecting leg extends. In one embodiment, the alignment projection may be configured to support the lamella. In this way it is achieved that the effect of the living nature of wooden lamella, i.e. the changes in shape due to changes in temperature or humidity, is minimised. As an example, the lamellae are likely to curve when the humidity is changing but they are kept in position by the alignment projection(s).

The alignment projection(s) may have a substantially triangular cross section. Further, the alignment projection(s) may have a substantially semicircular cross section. Also, the alignment projection(s) may have a rectangular cross section.

The lamella may be attached or affixed to the fixation element in a manner in which only one surface is in contact with the fixation element, e.g. one face of a lamella having a square cross section or the substantially flat surface of a semi circular cross section.

In this way it is possible to ensure that the lamella follows the longitudinal extension of the fixation element, i.e. that the longitudinal axis of the lamella is substantially parallel with the longitudinal axis of the alignment projection(s).

The alignment projection may extend in the full length of the fixation element. In this way it is possible to manufacture the fixation element by extrusion, e.g. in aluminium.

The alignment projection may be broken along the length of fixation element. In this way it is possible to form the fixation element and the alignment projection(s) by rolling, folding or other shaping processes.

The alignment projection may be arranged so as to project into a groove in the lamella. The alignment projection may be arranged so as to abut a part of an outer surface of the lamella.

Also, the first projecting leg may have a first extension and the second projecting leg may have a second extension, the first and second extensions being 5-100 mm, more preferred 7.5-75 mm, or even more preferred 10-50 mm.

Furthermore, the projecting legs may extend approximately 15 mm from the body.

Moreover, the extensions of the first and second projecting legs may be identical.

In addition, the extensions of the first and second projecting legs may be different from each other.

Both the first and the second projecting legs may comprise an end part of increased thickness.

The first projecting leg and the second projecting leg of the fixation member may be flexible in such way that the distance between the first and second projecting legs may be increased or decreased during mounting of the fixation element with the mounting element.

In this way it is achieved that the end parts and thereby the fixation element may be lockingly engaged as a snap-lock function. The second leg and/or the first leg may be sufficiently flexible in order for the end part having an increased thickness to be pushed past a part on the mounting element in order to regain the initial position, whereby the fixation element and the mounting element are locked together.

In an embodiment, the fixation element may be made from a flexible material such a spring steel or spring strip steel. In this way it is possible to create easily accessible areas behind a section of the lamella system, e.g. for inspection purposes.

Further, the at least one alignment projection may have an outer surface, the outer surface being substantially even with an outer surface of the lamella.

Moreover, the lamella may comprise areas of reduced thickness in order to fit between two projecting legs of the fixation element.

In this way it is achieved that the outer surface and the fixation element form a substantially even surface.

Also, the lamella may be surface-treated, e.g. by paint or oil.

In a particular embodiment, the lamella may be acetylate-treated wood, e.g. known under the brand name Accoya.

Furthermore, the lamella may be affixed to the fixation element by screws.

The body of the fixation element may comprise a number of apertures.

Additionally, the body of the fixation element may comprise apertures, the apertures being 2-20 mm or 3-15 mm or 4-10 mm, or more preferred 5 mm, and a number of the apertures may be elongated apertures.

A number of the apertures may be elongated apertures.

In this way it is possible for the lamella to expand or subtract, i.e. extend or contract differently from the fixation element due to changes in temperature and humidity in the surrounding environment.

Moreover, the elongated apertures may have a longitudinal extension of 7.5-50 mm or 10-40 mm or 12.5-30 mm, or more preferred 15-20 mm.

Furthermore, the lamella front surface system may comprise a number of fixation parts. In this way it is possible to fix the fixation element to a mounting element in a controlled manner, i.e. either to allow for movement of the fixation element relative to the mounting element in a perpendicular direction along the longitudinal axis of the fixation element, or to fix the fixation element relative to the mounting element in a perpendicular direction along the longitudinal axis of the fixation element. Hence, it is possible to achieve a point with substantially no longitudinal movement due to humidity or temperature i.e. a "movement 0-point" and let the movement start from there. The movement is typically caused by changes in temperature and humidity. Since the movement is caused by changes in temperature, the fixation part may be said to provide "a fixation point" in relation to thermal changes.

Also, the lamella front surface system may comprise a plurality of mounting metal elements, each being mounted to the face with a distance between them and a plurality of fixation elements supporting a plurality of lamellae.

In an embodiment, the fixation element may comprise a lip arranged to close the gap between two abutting fixation elements. In this way it is achieved that the fixation elements form a substantially closed face protecting the surface behind e.g. a wall or sealing.

The substantial vertical face may be part of a wall of a building or may be part of a vertical beam or post.

The present invention also relates to use of the lamella front surface system as described above for at least partially covering a structure such as a building or a part of a building.

The present invention also relates to a building comprising a lamella front surface system as described above.

Further, the present invention relates to a method for creating a front surface covering a structure with non-metallic lamellae.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
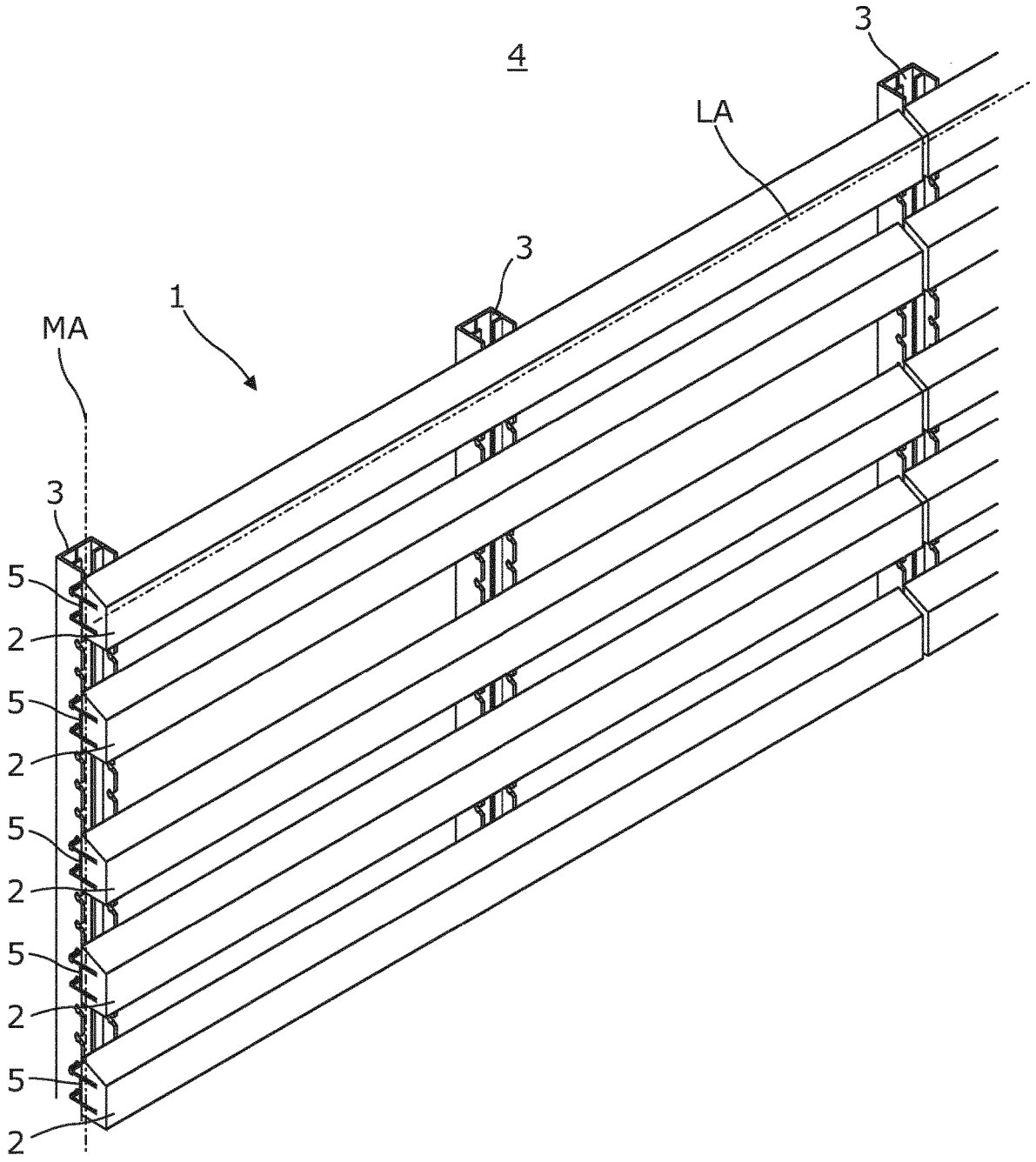
FIG. 1 shows a lamella front surface system according to the invention.

FIG. 1 shows a lamella front surface system 1. In this figure, the system is shown comprising five non-metal lamellae 2 and three metal mounting elements 3. The mounting elements 3 have amounting axis MA. The mounting elements 3 are attached to a support 4, in this case a face 4 of a building. The lamellae 2 have a longitudinal axis LA. In this embodiment, the mounting axis MA of the metal mounting element 3 is substantially perpendicular to the longitudinal axis LA of the lamellae 2. The lamellae 2 are connected with the metal mounting elements 3 by a fixation element 5 (shown in greater detail below).

It will be understood that the lamella front surface system could comprise a plurality of mounting metal elements, each being mounted to the face with a distance between them and a plurality of fixation elements supporting a plurality of lamellae. The extension of the metal mounting elements and the lamellae and fixation elements may be up to 6000 mm or even more.

Figure 2:
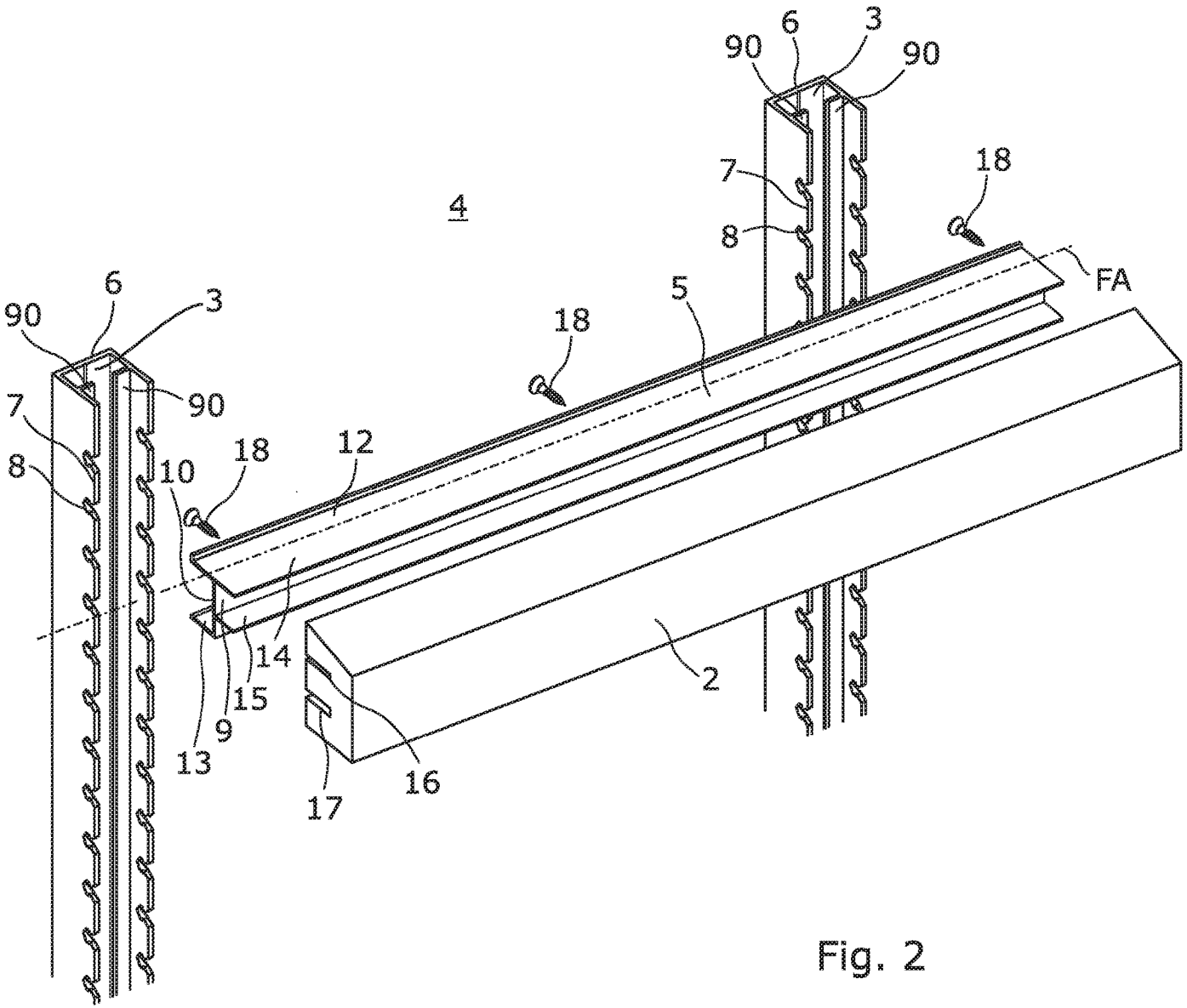
FIG. 2 shows an exploded view of the components of the lamella system of FIG. 1.

FIG. 2 shows the lamella front surface system 1 of FIG. 1 in an exploded view. Each of the metal mounting elements 3 comprises a mounting side 6 abutting the face 4 of the building. The mounting element 3 further comprises an interfacing side 7 opposing the mounting side 6. The interfacing side 7 comprises attachment means 8. In this embodiment, the attachment means on the mounting element 3 is a number of slots or grooves (only a few are numbered with reference numerals). Only one lamella 2 is shown. However, it will be understood that the system may be expanded to comprise an infinite number of elements and lamellae. The lamella 2 is attached with the metal mounting element 3 via the fixation element 5 having a longitudinal axis FA and hence a longitudinal extension. The fixation element 5 comprises a body 9 having a first side 10 and a second side 11. The first side 10 comprises interfacing means, i.e. projecting legs 12, 13. In this embodiment, the interfacing means comprises a first projecting leg 12 and a second projecting leg 13. The projecting legs 12, 13 are configured to be connected with the attachment means 8, i.e. the slots or grooves 8 of the interface side 7 of the mounting element 3. The second side 11 of the body 9 of the fixation element 5 is configured to support the lamella 2 along the longitudinal axis of the fixation element FA in order to keep the longitudinal axis LA of the lamella 2 in a substantially parallel position. In this way the lamella 2 is kept in a position which is substantially perpendicular to the mounting axis MA of the metal mounting elements 3. The second side 11 of the fixation element 5 comprises a first alignment projection 14 and a second alignment projection 15. The alignment projections 14, 15 project from the second side 11 of the body 9 of the fixation element 5. The alignment projections 14, 15 are arranged to be inserted into slots 16, 17 in the lamella 2. In this way it is achieved that the lamella 2 is kept in a position which is substantially parallel to the fixation element 5, and in this embodiment furthermore substantially perpendicular to the mounting elements 3. In this embodiment, the lamella 2 is affixed to the fixation element 5 by means of screws. It will be understood that the fixation of a lamella to the fixation element 5 may be carried out in several ways, still allowing for contraction and expansion of the lamella, e.g. by means of speed prongs in a groove in the lamella or an elastic glue. In this embodiment, the lamella is made of wood but may be made from various kinds of non-metal material, such as wood fibre composites, rock, glass or fibre glass.

The longitudinal extension of the lamella 2 is different from a length of the fixation element 5. In this way it is achieved that the lamella and the fixation element may expand or contract differently. If the lamella 2 is made of e.g. wood and the fixation element is made of aluminium, their respective elongation due to changes in temperature is different. Furthermore, wood typically expands due to an increase in humidity in the air which aluminium does not, and hence a change in humidity is likely to cause the lamella to increase in length compared to the fixation element. The metal mounting element and the fixation element may be made of a number of metals such as aluminium, alloys of aluminium and at least one other metal or stainless steel.

Furthermore, lock projections 90 are shown in each side of the mounting element 3 extending in a plane substantially parallel to the mounting side 6 of the mounting element 3. The lock projections will be described further in FIGS. 8, 9 and 10.

In the embodiment shown in FIG. 1 and FIG. 2, the longitudinal extension of the lamella 2 is more than 5 mm longer than the longitudinal extension of the fixation element. In this embodiment, the fixation element 5 is 890-990 mm and the lamella 2 is 990-1010 mm.

In this embodiment, the projecting legs extend approximately 15 mm from the body.

Figure 3:
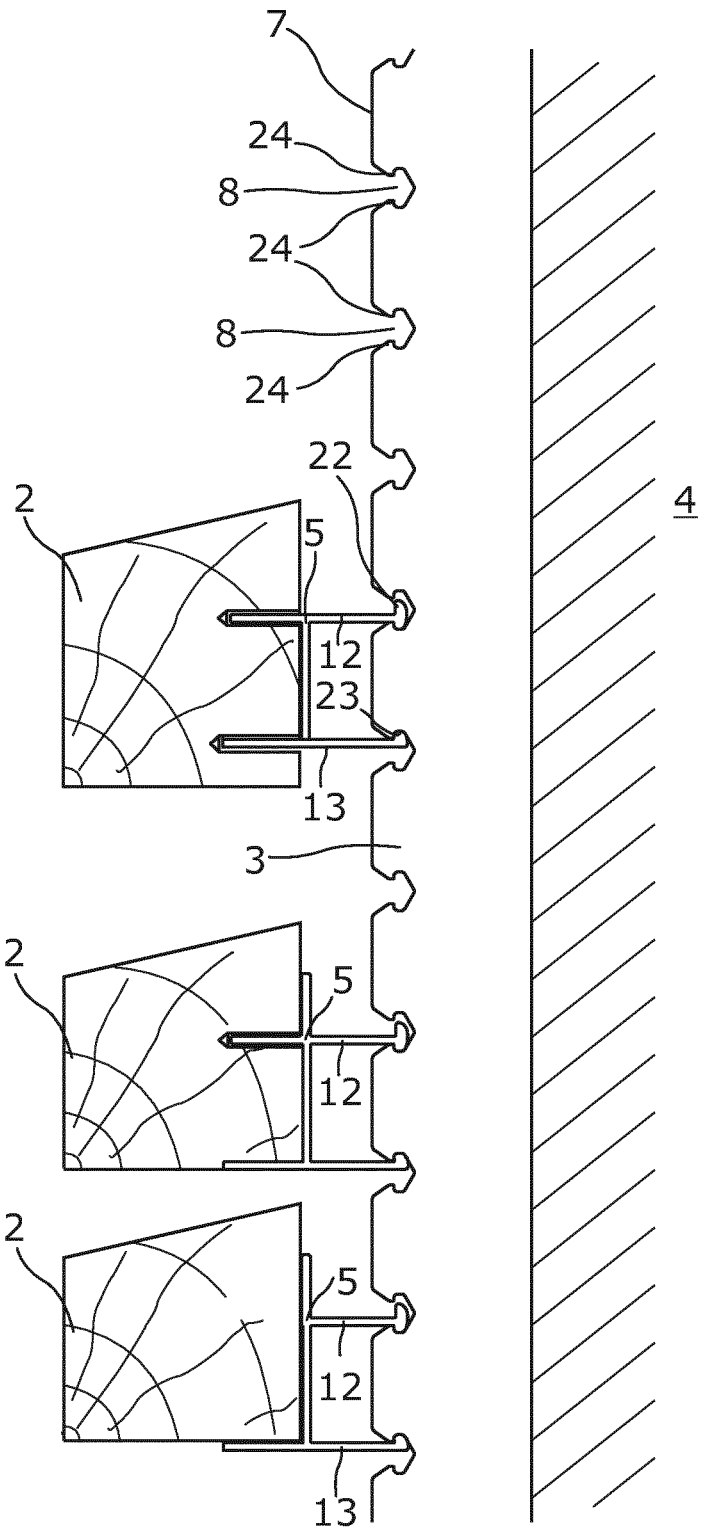
FIG. 3 shows a cross-sectional view of the lamella mounted on a fixation element.

FIG. 3 shows a part of a lamella front surface system 1 seen from the side. The lamella 2 is connected with the mounting element 3 via the fixation element 5. It is seen that the projecting legs 12, 13 comprise end parts 22, 23 with an increased thickness. The end parts 22, 23 having an increased thickness facilitates that the fixation element 5 can be lockingly engaged with the mounting element 3. The grooves 8 in the mounting element 3 comprise a projection 24 which the end part 22, 23 need to pass when inserted in the groove 8. In this way, a simple and reliable snap lock function is obtained. The mounting process of the fixation element 5 with the mounting element 3 is described below in FIG. 5. FIG. 3 shows that three embodiments of the fixation element 5. The attachment of the lamella 2 to the fixation element 5 may be carried out in various ways e.g. using screws or glue (not shown).

FIGS. 4A-4D show different embodiments of the fixation element 5 having the same lamella 2 connected thereto.

Figure 4A:
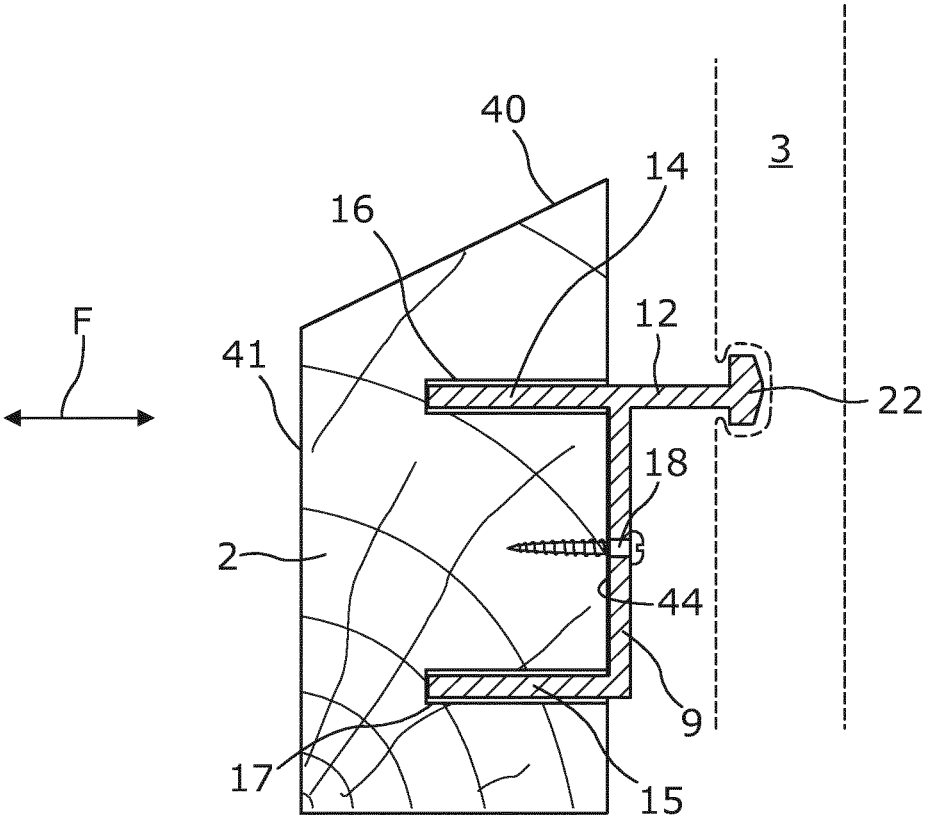
FIGS. 4A-E show different embodiments of the fixation element.

FIG. 4A shows an end view of an embodiment of the fixation element 5 having a lamella 2 affixed thereto. In this embodiment, the fixation element comprises one projecting leg 12, the projecting leg having an end part 22 with an increased thickness. The increased thickness extends to both sides of the projecting leg 12. In this way, after the fixation element 5 has been connected to the mounting element, the fixation element is locked in the direction of the arrow F (the mounting process is shown below in FIG. 5). When mounted, the fixation element 5 and therefore the lamella 2 may be positioned in a tilted position. In this way, e.g. the top surface 40 may be arranged parallel to the projection leg 12 but be arranged slanting. The slanted top surface 40 provides the possibility of leading e.g. rain water etc. away from the back mounting element 4 and typically the face of the structure. The lamella 2 may be arranged to compensate for this tilted position. In this way, the front surface 41 may still be arranged substantially parallel to the mounting element and the face of the structure (seen e.g. in FIG. 3). In this embodiment, the fixation element 5 comprises two alignment projections 16, 17 extending from the body 9 of the fixation element 5. The lamella 2 is affixed to the fixation element 5 by a screw 18. The screw 18 ensures that the lamella 2 is drawn towards an alignment surface 44 of the body 9. The screw(s) 18 may be arranged in elongated apertures. The alignment projections 14, 15 are inserted in the alignment slots 16, 17 arranged in the lamella 2. The slots 16, 17 may be filled with an elastomer or glue material.

Figure 4B:
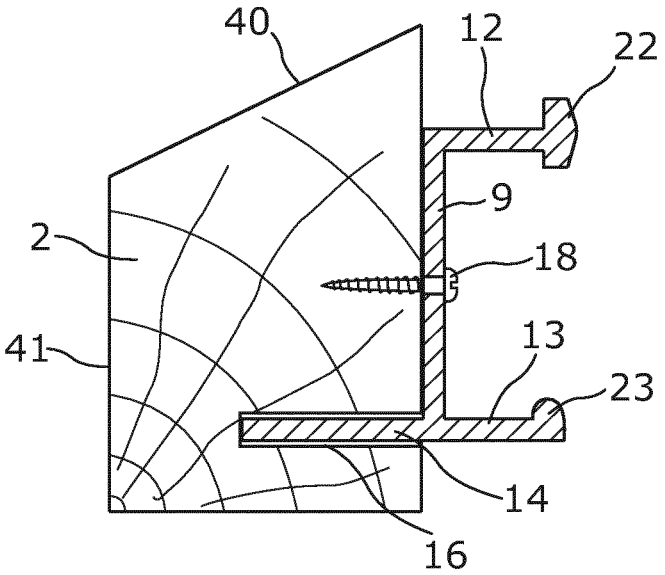

FIG. 4B shows an embodiment of the fixation element 5. In this embodiment, the fixation element 5 comprises one alignment projection 14 and one alignment slot 16. It will be understood by the skilled person that the alignment projection 14 could be arranged projecting anywhere along the body 9. If the alignment projection 14 is arranged at the middle of the body 9, the screw 18 would be moved accordingly to either the one or the other side of the alignment projection. It is seen that the top surface 40 of the lamella 2 and the front surface 41 are arranged similar to the embodiment shown in FIG. 4A, and hence it will be understood that the fixation element may take various shapes and still maintain the same appearance as the lamella 2.

Figure 4C:
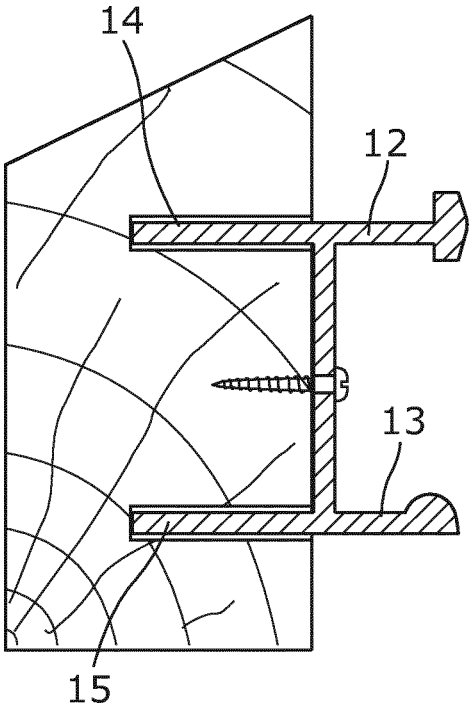

FIG. 4C shows an embodiment of the fixation element 5 which is also seen in FIGS. 1-3. FIG. 4C shows that the fixation element 5 comprises a first projecting leg 12 and a second projection leg 13 as well as a first alignment projection 14 and a second alignment projection 15. The end parts 22, 23 of the projecting legs 12, 13 are different from each other. The end part 22 has an increased thickness so that the increase in thickness projects both away and towards the end part of the second projecting leg 13. The increase in thickness of the second end part 23 of the second projecting leg only projects towards the first projecting leg 12. The first projecting leg 12 is similar to those shown in FIGS. 1-3, 4, 4A and 4B.

Figure 4D:
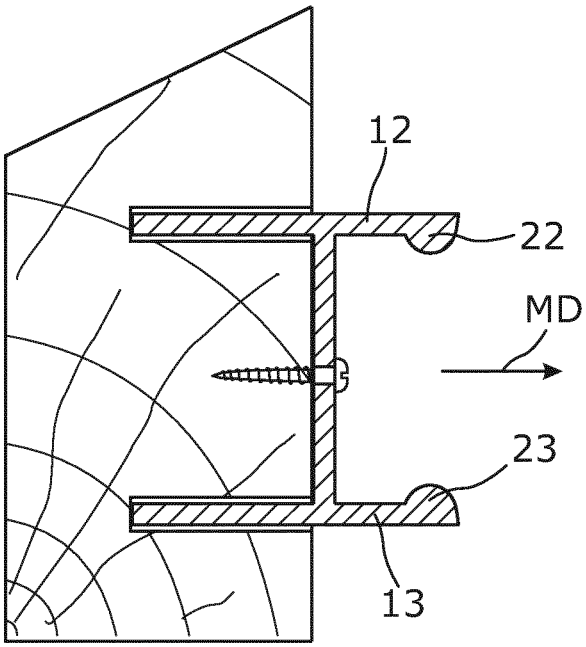

FIG. 4D shows a further embodiment of the fixation element 5. In this embodiment, the first and the second projection legs 12, 13 of the fixation element 5 comprise end parts having a similar increased thickness. The increase in thickness of each of the end parts 22, 23 of the projecting legs is arranged in a way that the increase of the one end part projects towards the other end part, i.e. the end parts have opposing projecting areas. Hence, the increase in thickness is a projection along the longitudinal axis FA of the fixation element 5.

In this embodiment, it is possible to attach the fixation element 5 and hence the lamella 2 to the mounting element directly in the direction of the arrow MD to the mounting element (not shown). This makes it possible to mount the lamellae 2 close to each other or have larger lamellae 2. It will be understood by the skilled person that this embodiment of the projecting legs of the fixation element 5 may be applied to all embodiments of the fixation element comprising a first and a second projecting leg.

The attachment means of the metal mounting element, i.e. the grooves 8, may in another embodiment be a separate part affixed to the metal mounting element. The separate part may comprise two projecting arms configured to receive the projecting legs of the fixation element 5. Such projecting arms is arranged to receive and lockingly engage with projecting legs as shown in both FIGS. 4C and 4D. The separate part may have a shorter extension along the longitudinal axis LA of the fixation part 5.

Figure 4E:
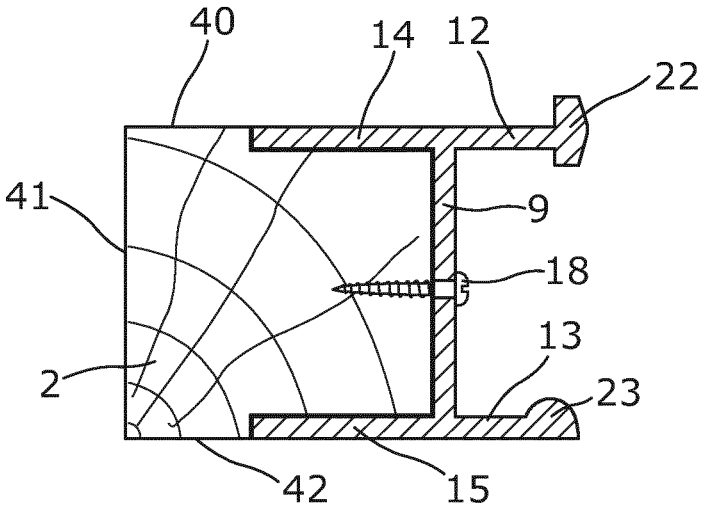

FIG. 4E shows another embodiment of the lamella 2 and the fixation element 5. In this embodiment, the alignment projections 14, 15 is substantially even with the top surface 40 of the lamella and bottom surface 42 of the lamella 2. In this embodiment, the slots 16, 17 are merely a section of the lamella 2 having a decreased thickness along the longitudinal axis LA of the lamella.

According to a further embodiment, it is to be understood that the lamella 2 may comprise one slot and a reduced thickness of just the one side, e.g. to create a substantially even top surface 40.

Figure 4F:
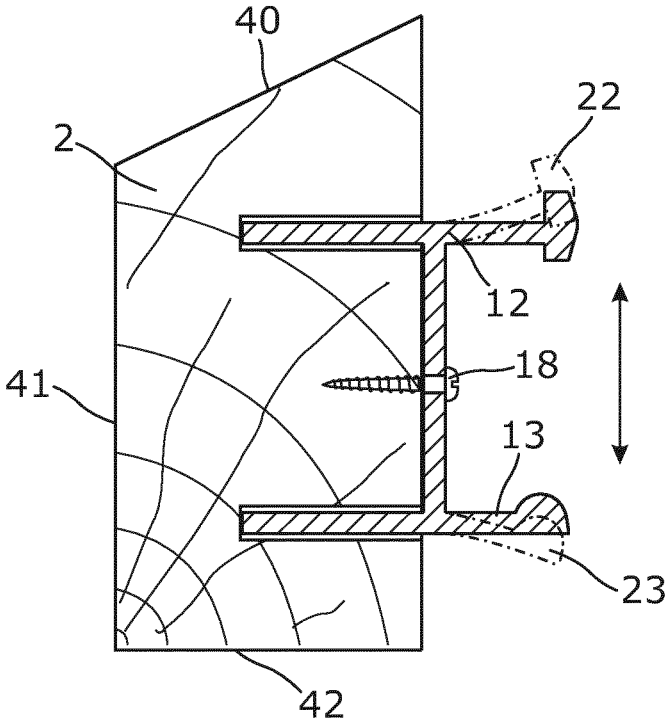
FIG. 4F shows the flexibility of the projecting legs of the fixation element.

FIG. 4F shows the flexibility of the projecting legs 12, 13. FIG. 4F is highly schematic and the flexibility is typically not more than a few millimetres which is sufficient to achieve a snap-locking effect. When mounting the fixation element 5 on the mounting element 3, i.e. inserting the projecting legs into the grooves 8, the second projecting leg 13 is the one to be inserted last. Hence, the second projecting leg 13 is more likely to be deflecting than the first projecting leg 12. This is due to the fact that the projection 24 of the groove 8 (seen in FIG. 3) supports the projecting leg at a point positioned further towards the body 9 of the fixation element. When the projection 24 supporting the projecting leg 12 is positioned further towards the body 9, the force subjected to the "arm" results in a smaller bending moment of the first projection leg 12 in relation to the second projecting leg 13. Hence, the second projecting leg 13 is more likely to deflect than the first projecting leg 12 when considering the same thickness of the legs.

The first projecting leg 12 is similar to those shown in FIGS. 1-3, 4, 4A, 4B and 4C.

Figure 4G:
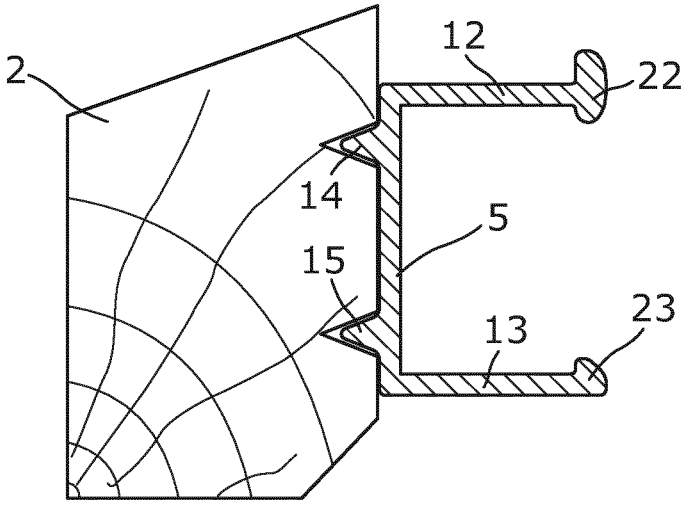
FIG. 4G shows a further embodiment of the fixation element.
Figure 4H:
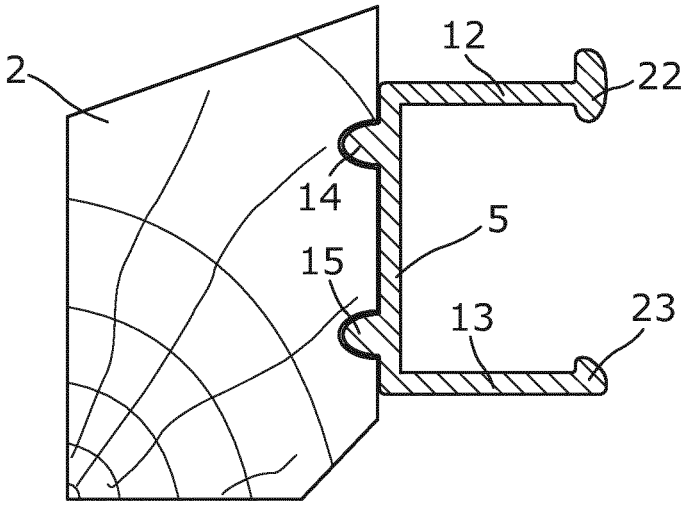
FIG. 4H shows a further embodiment of the fixation element.

FIG. 4G and FIG. 4H show further embodiments of the fixation element 5. In FIGS. 4G and 4H, the alignment projections 12, 13 are shorter in relation to the extension of the lamella than the alignment shown in FIGS. 1-4F. The alignment projections 12, 13 still keep the lamella 2 in position along the longitudinal axis of the fixation element 5. Furthermore, the triangular cross section of the alignment projections 12, 13 provide a sloped side of each alignment projection that will assist in carrying water from the first alignment projection 14 towards the second alignment projection 15. Typically, rain will be deflected by the lamella. However, in some instances the rain may find its way to the fixation element, and in these situations the present embodiment provides an improved water drainage. It will be understood that this issue may arise during horizontal mounting of the lamellae but it will be understood that the lamella mounting system may provide for the lamellae to be mounted in a vertical manner, too. Similar to FIG. 4G the embodiment shown in FIG. 4H will provide the same drainage of water. It is shown, that the end parts 22, 23 of the projecting legs may have a more rounded outline than the end parts shown in the other embodiments of the fixation element 5. It will be understood that the end parts shown in FIGS. 4G and 4H may also be similar to those of FIGS. 4A-4F, also in relation to an embodiment only comprising one projecting leg and one end part (as e.g. shown in FIG. 4A).

Figure 5:
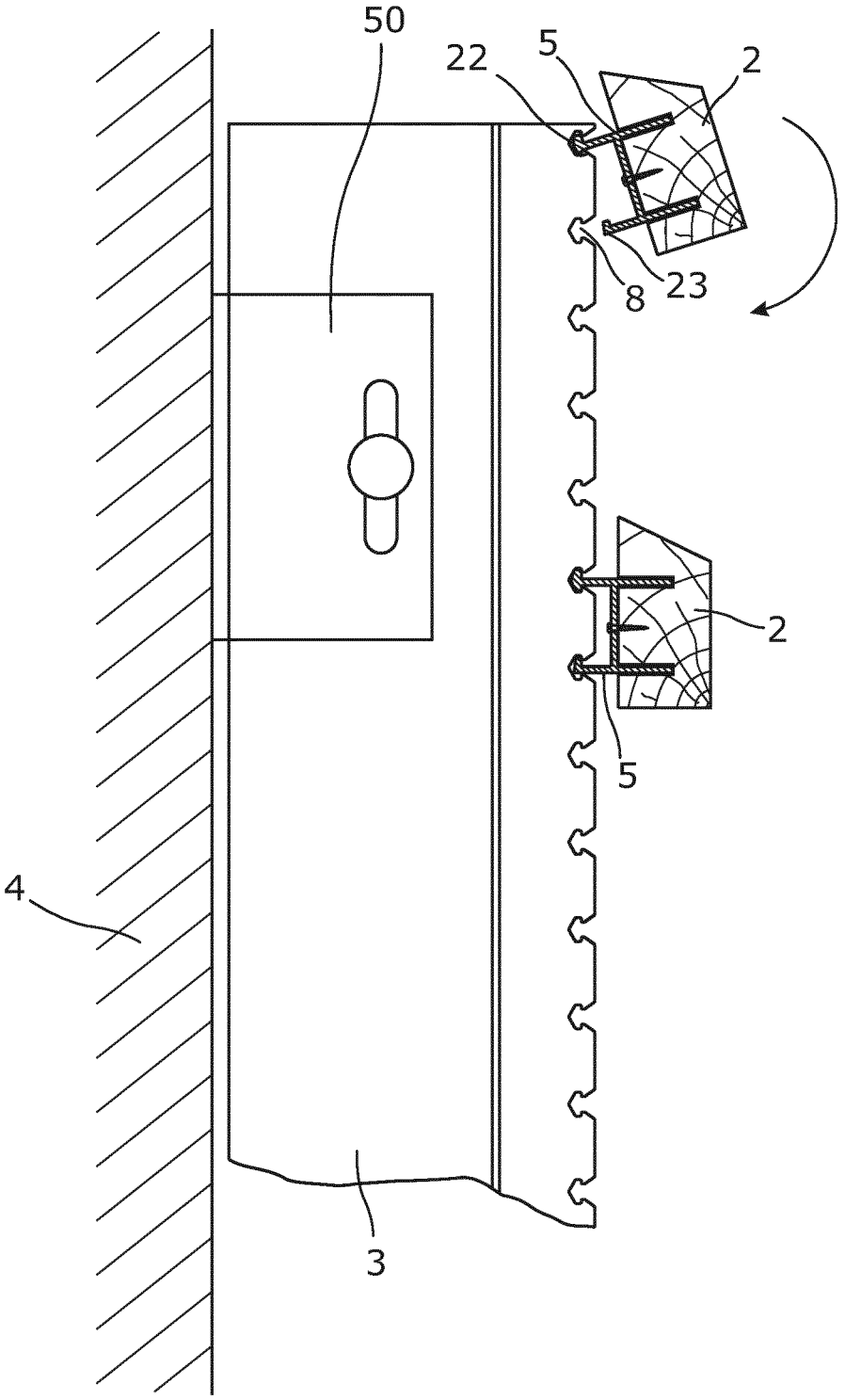
FIG. 5 shows the mounting process of fixating the lamella on a mounting element seen from the end of the lamella, i.e. the side of the mounting element.

FIG. 5 shows the mounting process when mounting a lamella 2 affixed to the fixation element 5 as seen comprising a first projecting leg 12 similar to the ones shown in FIGS. 1-3, 4, 4A, 4B and 4C. Due to the first end part 22 having an increased thickness extending to both sides of projecting leg 12, the end part 22 may not be inserted directly into the groove 8 due to the projections 24. However, when the fixation element 5 and hence the first projection leg 12 is tilted more than 10°, the end part 22 is so configured as to be able to be inserted in the groove 8. Having inserted the first end part 22 in a groove, the fixation element 5 and hence the first projection leg 12 are pivoted and the first end part 22 is in a locked position and hence prevented from being drawn out of the groove again. Pivoting the fixation element 5 even further, the second projecting leg 13 contacts a groove 8, and the increased end part 23 of the second projecting leg 13 only projecting towards the first projecting leg 12 ensures that the second end part still may be inserted in a groove. The increased thickness of the second end part 23 ensures that a snap lock function is achieved and that the fixation element 5 as a whole is locked to the mounting element 3. The fixation element 5 shown in FIG. 4D may be mounted in a similar manner, but this embodiment of the fixation element 5 further provides the possibility of mounting it directly along the arrow MD shown in FIG. 4D, i.e. without pivoting around the first end part 22 of the first projecting leg 12. The metal mounting element 3 is affixed to the face 4 by a bracket. The metal mounting element 3 may also be affixed to the face 4 by glue or by a screw e.g. an expansion screw.

Hence, the end part 22 of the first projecting leg 12 of the fixation element 5 and the connecting part of the metal mounting element 3 are arranged to be lockingly engaged substantially without touching each other during mounting of the fixation element 5 when inserting the end part 22 of the first projecting leg 12 from a position in which the first leg projecting 12, and thereby the fixation element 5 as a whole, is tilted by more than 5° and less than 80° from perpendicular to the metal mounting element 3.

FIGS. 6A-6D show further embodiments of the lamella 2 according to the invention. It will be understood by a person skilled in the art that the front surface of the lamella 2 may have various contours and shapes. As shown in FIG. 4A, it is furthermore shown that the top surface 40 and the front surface 41 may have a common area and as such not be separated by a distinct edge or similar.

Figure 6A:
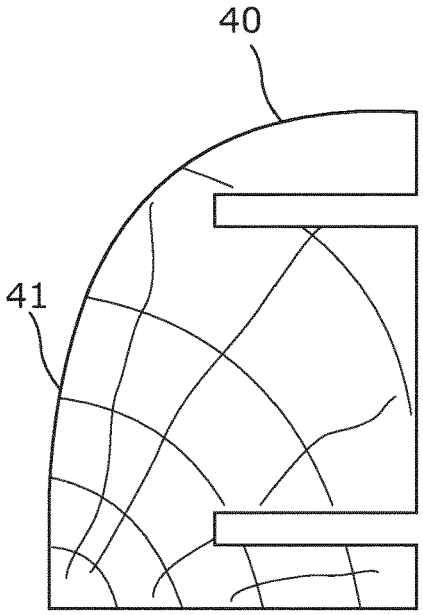
FIGS. 6A-D show, in a cross sectional view, further embodiments of the profile of the lamella, FIGS. 7A and 7B each show a part of a fixation element comprising apertures.
Figure 6B:
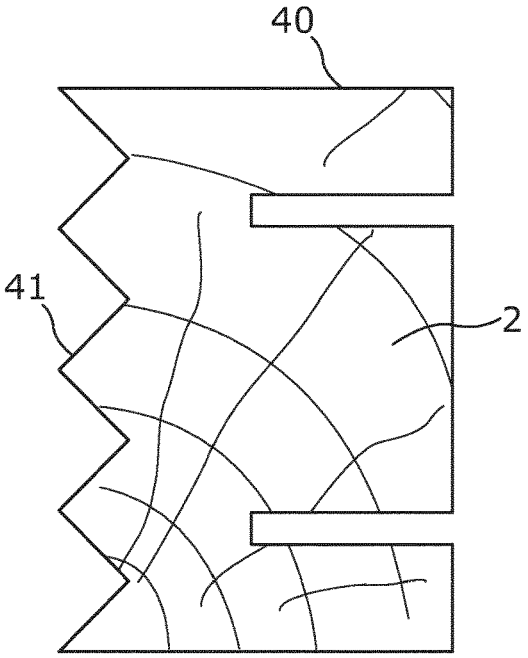
Figure 6C:
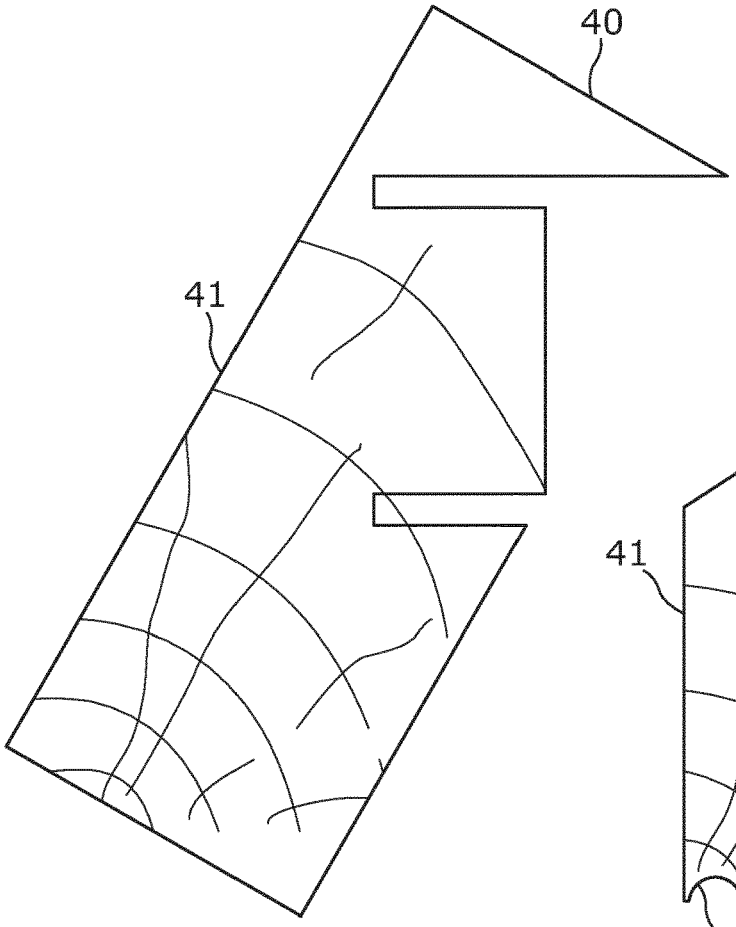
Figure 6D:
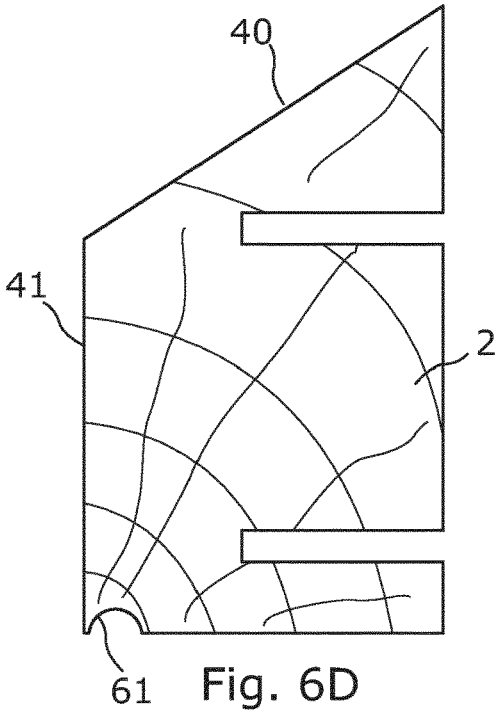

FIG. 6D shows a lamella 2 comprising a drip edge 61.

Figure 7A:
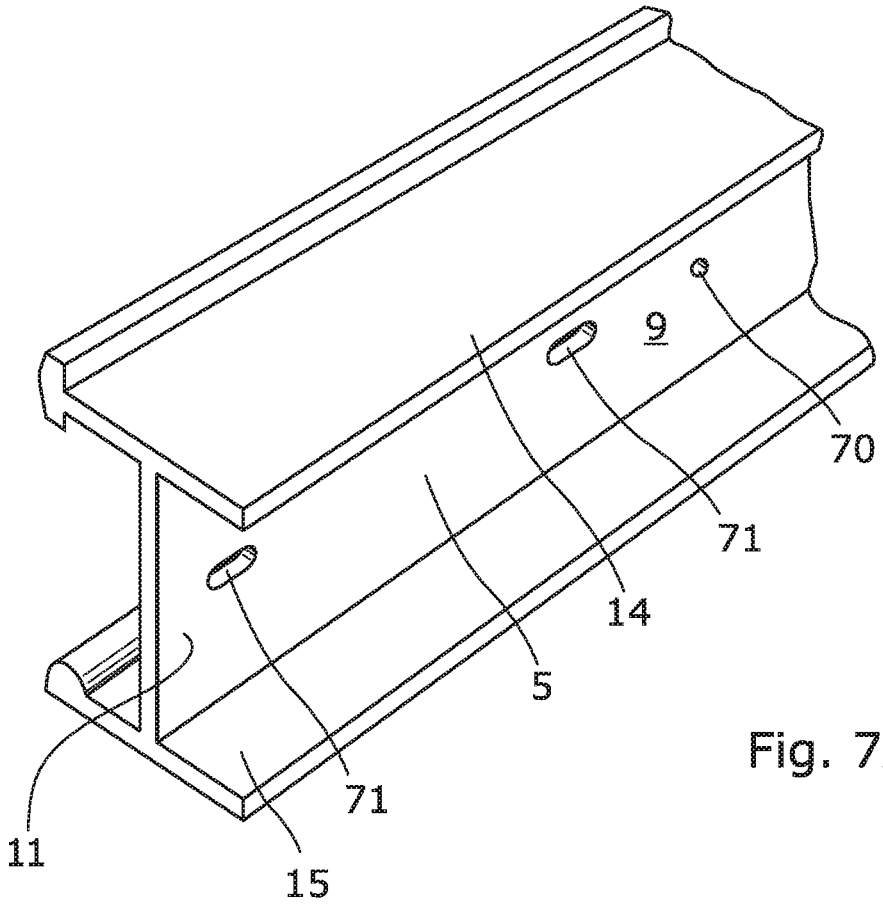
Figure 7B:
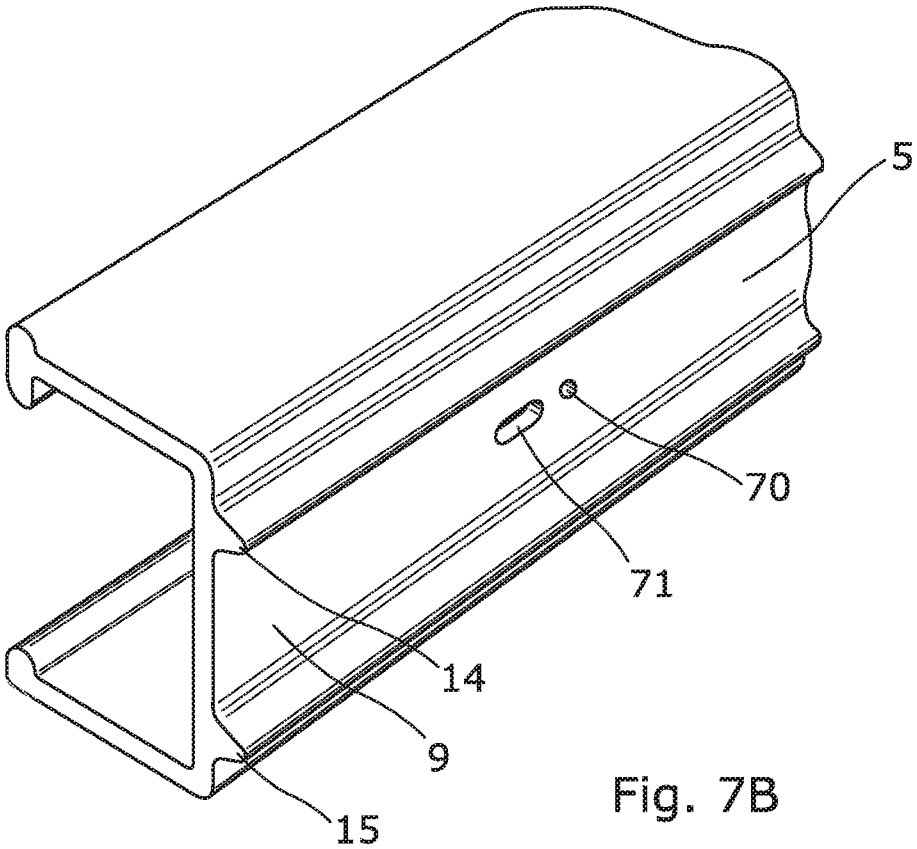

FIGS. 7A and 7B each show an embodiment of a section of a fixation element 5, wherein the body of the fixation element comprises a number of apertures 70.

The fixation element may comprise apertures that are 2-20 mm or 3-15 mm or 4-10 mm, or more preferred 5 mm. It is seen that a number of the apertures are elongated apertures. If the lamella (not shown) to be mounted to the fixation element 5 is less likely to expand, either due to the material of the lamella or the specific conditions of the surroundings in which the lamella front surface system is mounted, the apertures 70 may be substantially round. If the lamella is likely to contract or expand in relation to the fixation element 5, the apertures may be elongated. The elongated apertures 71 have a longitudinal extension of 7.5-50 mm or 10-40 mm or 12.5-30 mm, or more preferred 15-20 mm. In the embodiment shown in FIG. 7, the apertures 70, 71 are shown in the body 9 of the fixation element 5. It will be understood by a person skilled in the art that the apertures may be arranged in either the first or second alignment projection 14, 15 or in two or more of the body 9, the first alignment projection 14 and the second alignment projection 15. Furthermore, it is understood that the screws may be inserted through the lamella and into the fixation element 5. This may be carried out using blind holes in order to hide and/or protect the screw.

In this way it is possible for the lamella 2 to expand or subtract, i.e. extend or contract differently and at least along the longitudinal axis LA from the fixation element 5 due to changes in temperature and/or humidity in the surrounding environment.

In FIG. 7B it is shown that the elongated aperture 71 and the substantially round apertures 70 are arranged within 5-50 mm of each other. In this way, it is possible, along the full length of the fixation element, to decide the direction in which the wood may extend or subtract, e.g. due to changes in humidity or temperature. Workers may, at a site of mounting the lamella, change the point of fixation in order to adjust to the specific location, e.g. near corners. In this way, the overall appearance of the system will maintain its intended finish, e.g. near corners of a room or a building.

Figure 8A:
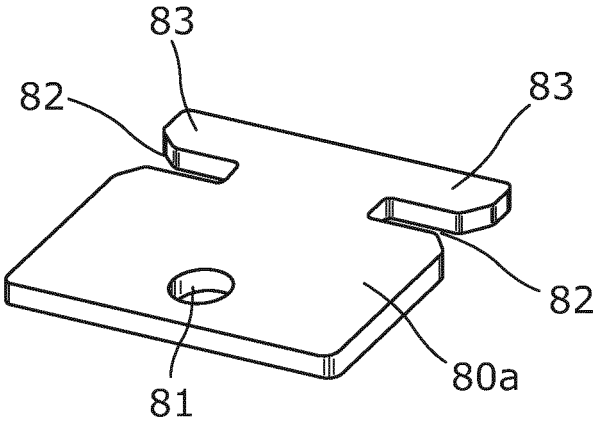
FIG. 8A shows a fixation part.
Figure 8B:
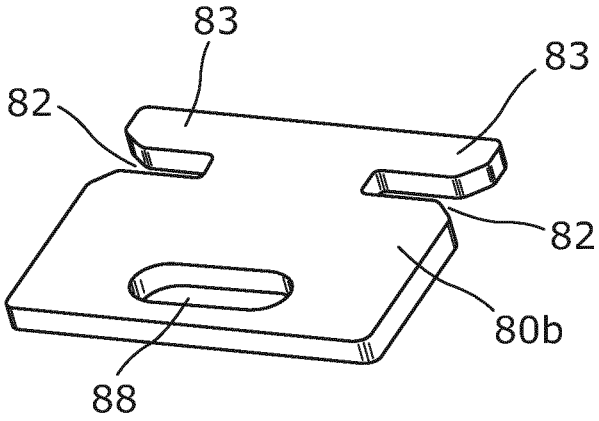
FIG. 8B shows a further fixation part.

FIG. 8A and FIG. 8B each show a fixation part (a fixation bracket) 80*a* and 80*b*. FIG. 8A shows a fixation part 80*a* having a substantially circular aperture 81. Opposing the side part comprising a circular aperture, the fixation part 80*a* comprises cut-outs 82 that delimits a part of the fixation part in order to constitute a lock part 83 in each side of the fixation element 80*a*. The lock parts 83 are arranged to engage with lock projections 90 of the mounting element 5 (not shown in FIGS. 8A and 8B, described in FIGS. 9 and 10).

Figure 9A:
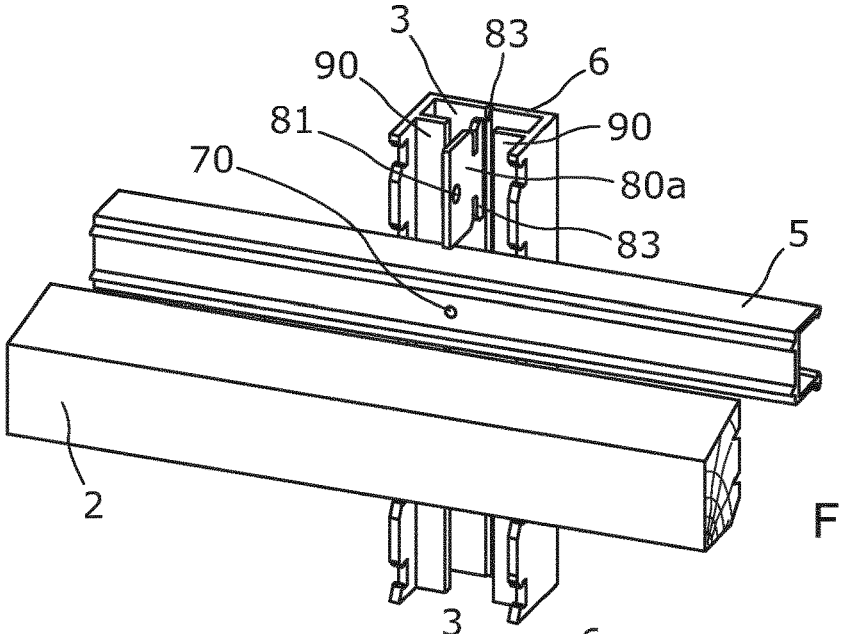
FIGS. 9A-C show the steps of mounting the fixation part shown in FIG. 8A, FIGS. 10A-C show the steps of mounting fixation part shown in FIG. 8B, FIGS. 11A-11D show, in cross-sectional views, embodiments of fixation elements having more than one lamella.
Figure 9B:
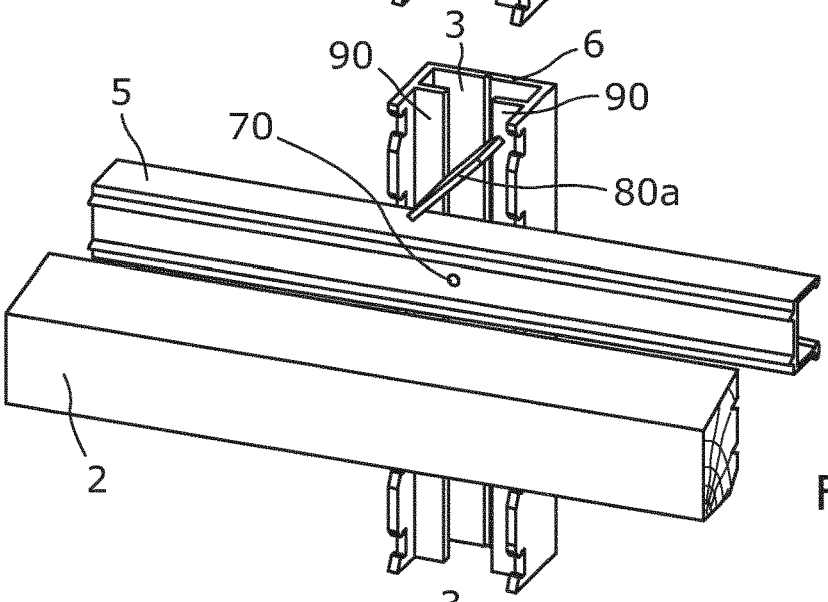
Figure 9C:
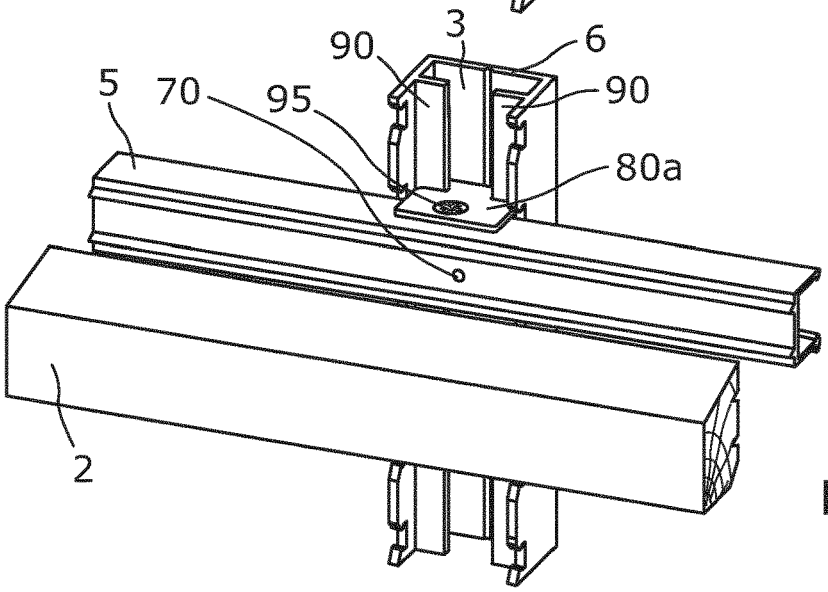

FIGS. 9A-9C show the mounting of the fixation element 80*a*. It is shown that the fixation part 80*a* is locked to the mounting element 3 in each side of the mounting element 3 by engaging locking projections 90 extending in a plane substantially parallel to the mounting side of the mounting element 3. Simply by rotating the fixation part 80*a* ninety degrees, the lock parts 83 of the fixation part 80*a* are lockingly arranged between the locking projections 90 and the mounting side 6. In this locked position the locking projections 90 are arranged in the cut-outs 82. In this way, the fixation part 80*a* is fixed in a plane perpendicular to the mounting element 3. Then, when mounting a screw or similar through the aperture 81 (only visible in FIG. 9A) and into the fixation element 5, the fixation element 5 is fully affixed to the mounting element 3.

Figure 10A:
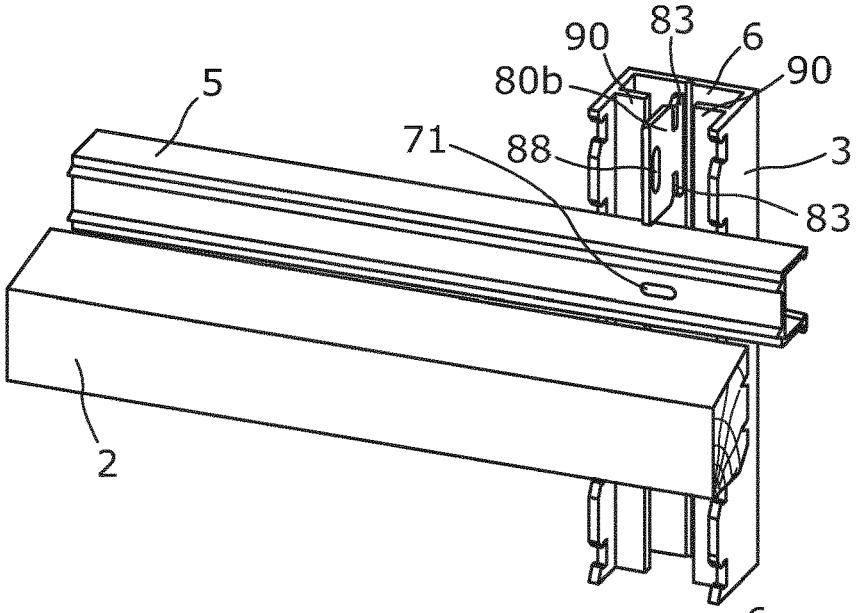
Figure 10B:
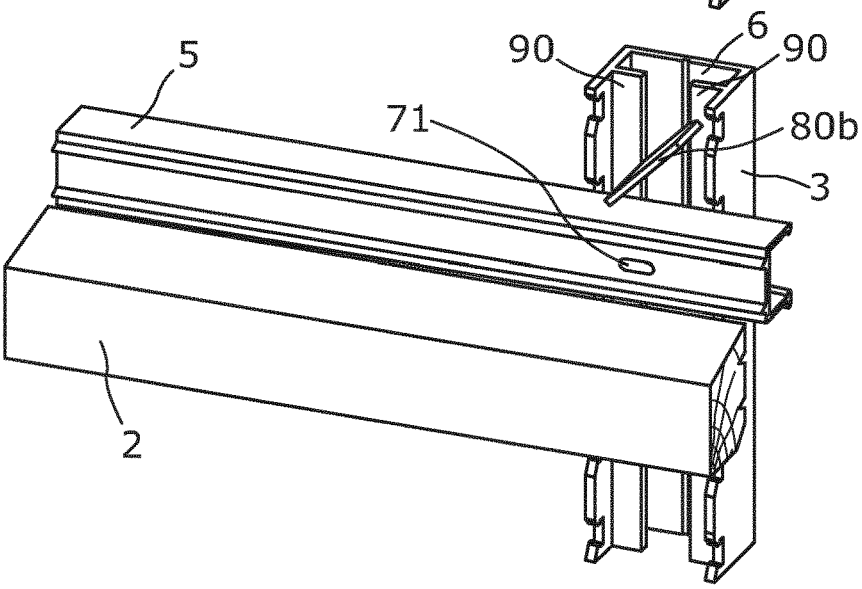
Figure 10C:
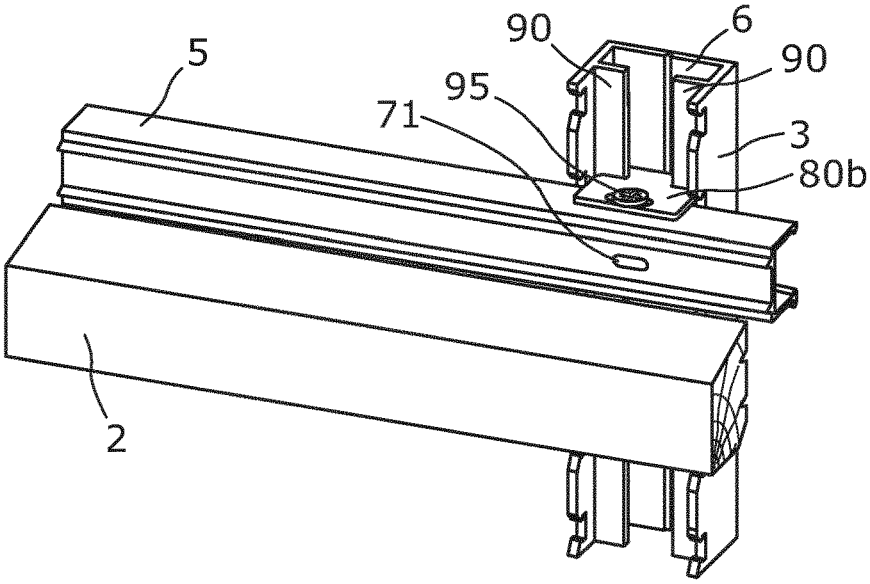

FIGS. 10A-10C show the mounting of the fixation element 80*b*. It is shown that the fixation part 80*b* is locked to the mounting element 3 in each side of the mounting element 3 by engaging locking projections 90 extending in a plane substantially parallel to the mounting side of the mounting element 3. Simply by rotating the fixation part 80*b* ninety degrees, the lock parts 83 of the fixation part 80*b* are lockingly arranged between the locking projections 90 and the mounting side 6. In this way, the fixation part 80*b* is fixed in a plane perpendicular to the mounting element 3. Then, when mounting a screw or similar through the elongated aperture 88 and into the fixation element 5, the fixation element 5 is affixed to the mounting element 3, but only in a direction perpendicular to the mounting side of the mounting element 3. The elongated aperture 88 allows for movement of the lamella along the longitudinal axis (LA shown in FIG. 1) in relation to the fixation element 5 due to changes in temperature.

In this way it is shown in FIGS. 8A and 8B FIGS. 9A-C and FIGS. 10A-C that the fixation part 80*a* provides a 0-point for the longitudinal movement of the fixation element 5. Since most of the longitudinal movement arises from changes in temperature, this 0-point may also be called a thermal fixation point, i.e. a fixed point of the lamella 2 and fixation element 5 despite thermal changes. The fixation part 80*b* provides a fixation in a manner that the fixation element 5 may still be moving along the longitudinal axis LA of the fixation element 5 but in other directions fully affixed to the mounting element 3, i.e. securing the fixation element 5 in the opposite direction of the mounting direction MD shown in FIG. 4D. It will be understood that the fixation parts 80*a* and 80*b* primarily will be affixed to the side of the fixation element 5 comprising the second projecting leg 13. This is due to the substantially flat surface of the second leg 13. However, it will also be possible to mount the fixation parts to the other side, i.e. first leg 12. The effect of the fixation parts 80*a* and 80*b* are the same no matter whether they are mounted from below, e.g. if mounted to the system shown in FIG. 3 and FIG. 5 or from above as shown in FIGS. 9A-C and 10A-C.

In FIGS. 9A-C it is shown that the substantially circular aperture 70 is present in the fixation element. In this way the 0-point for movement of the lamella 2 in relation to the fixation element 5 is in the same position as the 0-point for the fixation element 5 in relation to the mounting element 3. Due to the fact that the lamella 2 and the fixation element expand and contract differently due to their different materials, it is possible to the control the visual effect of the different expansion and contraction. If the 0-point is placed near the end of a lamella and the fixation element 5, it is achieved that the visual effect is in fact primarily visible in the opposing end. In the same way, it is possible to fix the lamella and the fixation element at the midpoint of the fixation element and hence achieve that the total relative movement between the lamella and the fixation element is divided to take place at each end, i.e. half the total relative movement in each end. In this situation, the relative movement will typically be directed in opposite direction when comparing the one end in relation to the other end. Therefore the total relative movement is considered in numerical (absolute) values.

Figures 11A, 11B, 11C, 11D:
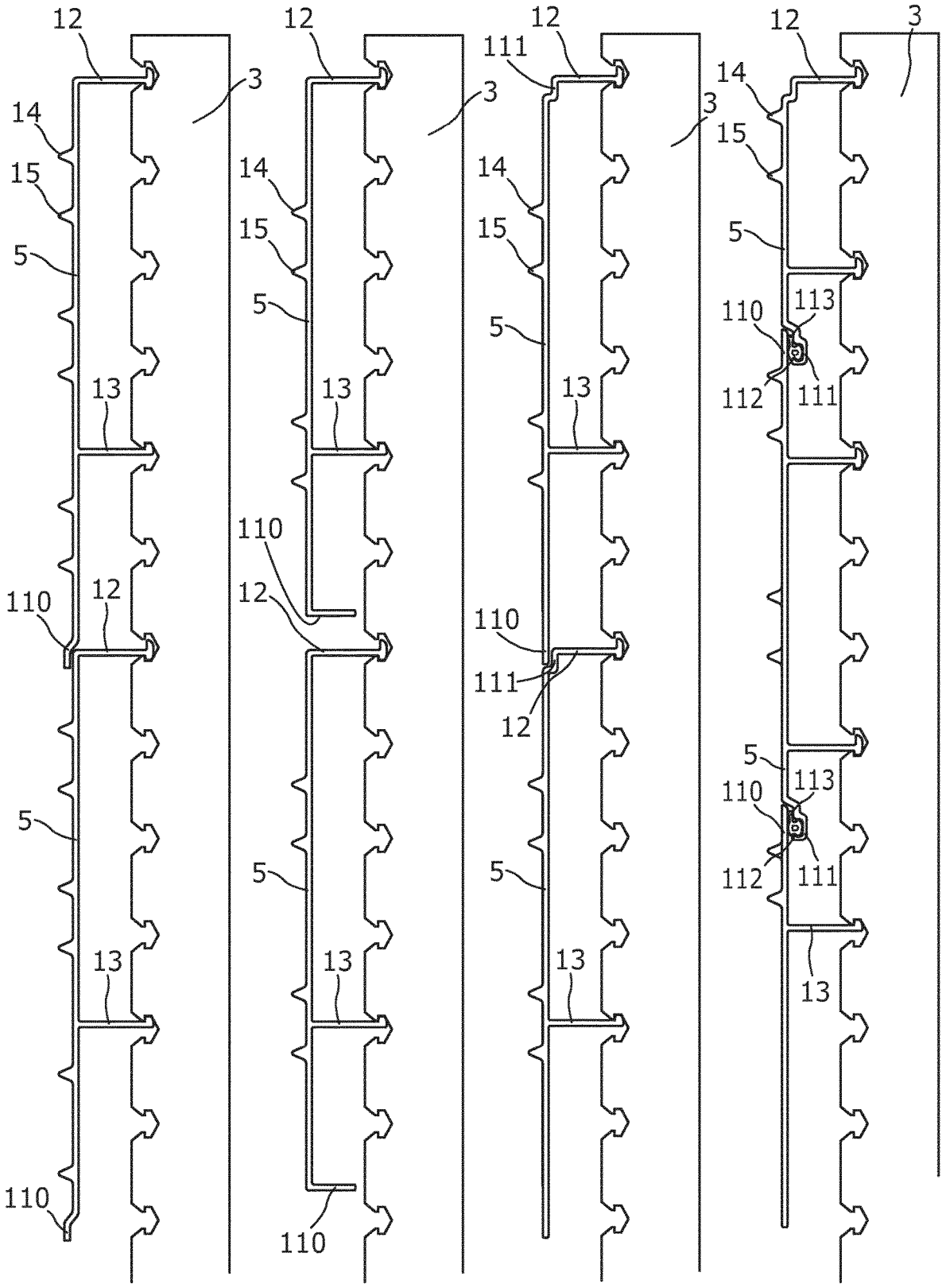

FIG. 11A shows an embodiment of the fixation element 5 comprising multiple sets of first and second alignment projections 14, 15. It is seen that the two fixation elements 5 comprises alignment projections for comprising three lamellae (not shown). It is seen that the fixation elements 5 are fixated to the mounting element 3 in the same manner as if each fixation element 5 only comprised one lamella. It is shown that the fixation element 5 comprises an extended portion 110 abutting an abutting fixation element 5. The fixation element and/or the extended portion may comprise a lip made of e.g. natural rubber or similar and in this way create a substantially closed surface.

FIG. 11B shows an embodiment of the fixation element 5 comprising multiple sets of first and second alignment projections 14, 15. It is seen that the two fixation elements 5 comprise alignment projections for comprising two lamellae (not shown). It is seen that the fixation elements 5 are fixated to the mounting element 3 in the same manner as if each fixation element 5 only comprised one lamella. It is shown that the fixation element 5 comprises an extended portion 110 arranged substantially in a 90° angle to the body of the fixation element 5.

In this way it is achieved that only a minor part of the mounting element 3 is visible and a closed appearance is provided.

FIG. 11C shows an embodiment of the fixation element 5 comprising multiple sets of first and second alignment projections 14, 15. It is seen that the two fixation elements 5 comprise alignment projections to comprise three lamellae (not shown). It is seen that the fixation elements 5 are fixated to the mounting element 3 in the same manner as if each fixation element 5 only comprised one lamella. It is shown that the fixation element 5 comprises an extended portion 110 abutting an abutting fixation element 5. The fixation element and/or the extended portion may comprise a lip made of e.g. natural rubber or similar and in this way create a substantially closed surface. In this embodiment, the fixation element further comprises an indentation 111 arranged to at least partly receive the extending portion 110. Similar to the embodiment shown in FIG. 11A, this embodiment closes the surface in order to create a uniform appearance and to protect the wall/surface behind the system. The extending portion 110 or the indentation 111 may comprise a lip made of rubber or similar (not shown).

FIG. 11D shows a system similar to that of FIG. 11C. In this embodiment, the indentation 111 further comprises an insert 112 made from e.g. rubber or similar flexible material. The insert 112 constitutes as a lip itself and therefore closes the gap between two abutting fixations elements 5. The insert may further comprise a projecting lip 113 and in this way achieve that even further sealing is obtained. In this way it is achieved that the system provides an improved sealing against e.g. rain or snow. The embodiment shown in FIG. 11D is shown without a mounted wood lamella but it will be understood that these are mounted as shown in e.g. FIG. 12 using the first and second alignment projections 14, 15.

FIG. 11A-11D show that the first and second projecting legs 12, 13 are arranged similarly to fixation elements holding just one lamella. Furthermore, it is seen that the alignment projections 14, 15 may be carried out in a similar manner on all embodiments.

Figure 12:
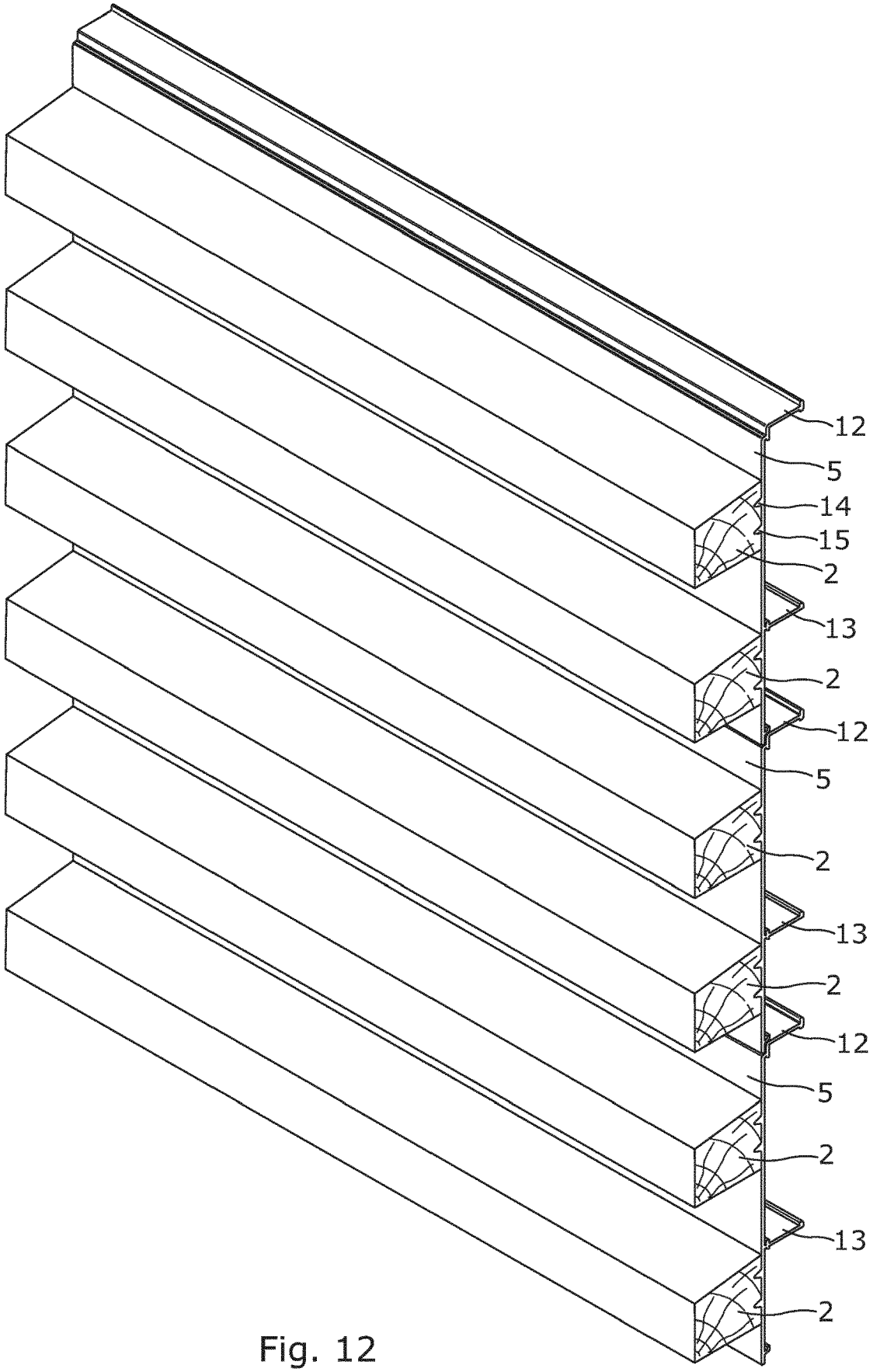
FIG. 12 shows the embodiment of FIG. 11C comprising wooden lamellae.

FIG. 12 shows the lamella system shown in FIG. 11C having the lamellae 2 mounted on the fixation elements 5. It is seen that the first and second alignment projections 14, 15 fixate the lamellae in a similar manner as to fixation elements comprising one lamella. The first and second projection legs 12, 13, are arranged similarly to fixation elements holding just one lamella.

Figure 13:
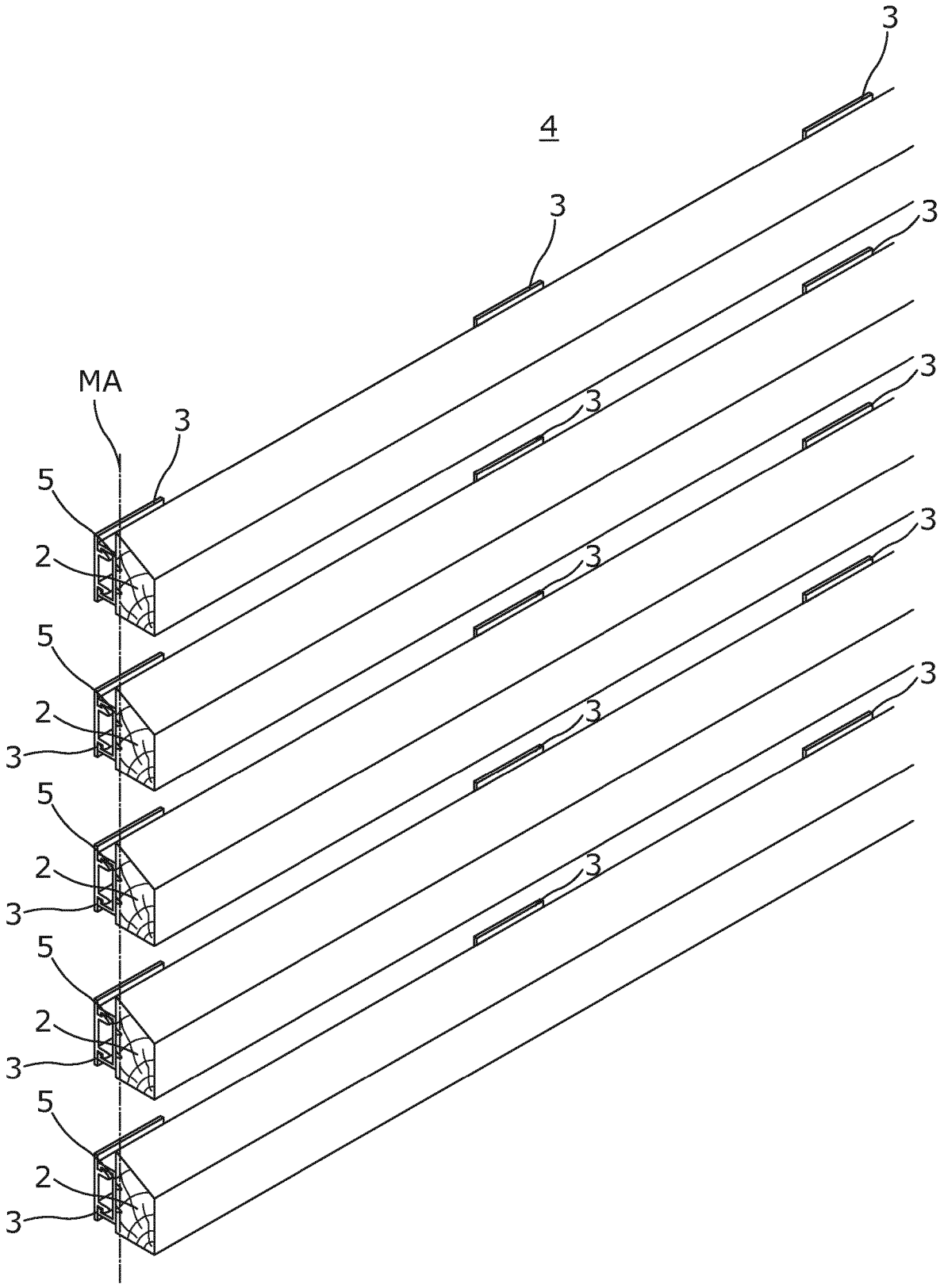
FIG. 13 shows an embodiment of the system comprising a further embodiment of the mounting elements.

FIG. 13 shows an embodiment of the system comprising smaller mounting elements 3. The mounting of a fixation element 5 to a face 4 of a building, e.g. a wall, ceiling or façade, is carried out by two or more individual mounting elements 3. The mounting axis MA is substantially perpendicular to the longitudinal axis of the fixation element, i.e. the lamella 2. The mounting element 3 may be individual sections of the mounting elements shown e.g. in FIG. 1, 2, 3 or 11. However, the individual nature of the mounting element facilitates a further embodiment shown in detail in FIG. 14.

Figure 14:
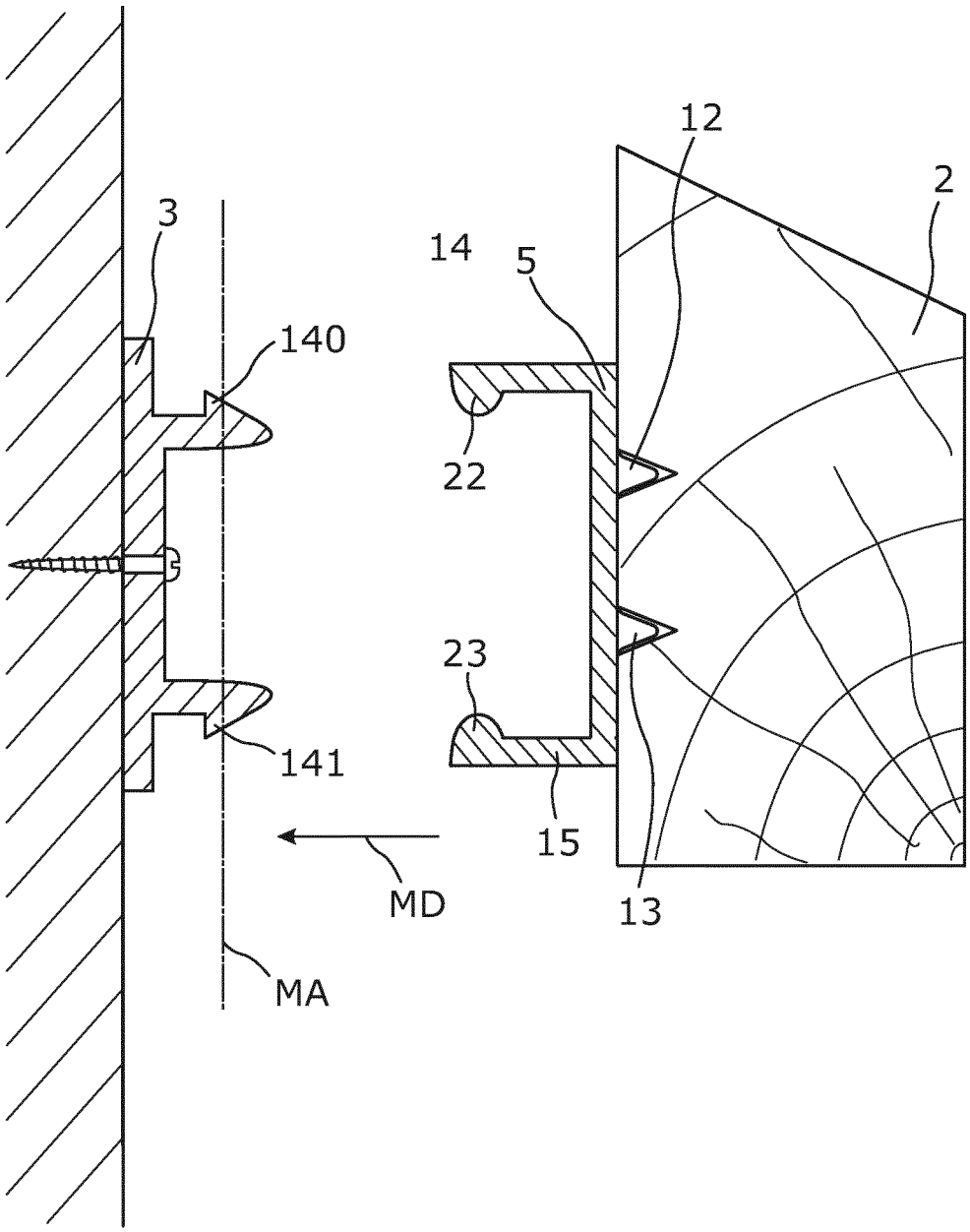
FIG. 14 shows a detailed cross-sectional view of the mounting element shown in FIG. 13.

FIG. 14 shows an embodiment of the mounting element 3. In this embodiment, the mounting element 3 is arranged to lockingly engage with the fixation element 5 by providing projection portions 140, 141 for lockingly engage with the embossed regions 22, 23 of the projecting legs 12, 13 of the fixation element 5. When the fixation element is forced in the mounding direction MD to engage with the mounting element 3, the projecting legs 12, 13 deflect (similar to what is shown in FIG. 4F) and lock behind the projecting portions 140, 141. It is shown that the lamella 2 is kept in position by projections 12, 13 similar to other embodiments.

Although the invention has been described in the above in connection with preferred embodiments of the invention, it will be evident for a person skilled in the art that several modifications are conceivable without departing from the invention as defined by the following claims.

The invention claimed is:

1. Lamella front surface system, comprising:

at least one lamella having a length, at least two metal mounting elements each having a mounting axis configured to be attached to a support face of a building, each of the metal mounting elements comprising:

a mounting side abutting the face in its mounted position, an interfacing side arranged opposite the mounting side, the interfacing side comprising attachment structure, wherein the lamella front surface system further comprises:

a fixation element extending substantially the entire length of the lamella, the fixation element having a longitudinal extension and having:

a body having a first side comprising interfacing structure configured to be connected with the attachment structure, and a second side configured to support the lamella in a position which is substantially perpendicular to the mounting axis of the metal mounting elements, and wherein the lamella is made from a non-metal material, wherein the fixation element comprises at least one alignment projection extending from the side of the body opposite the side from which at least one first projecting leg extends, the at least one alignment projection being received within a groove or notch of the lamella, and wherein the lamella and the fixation element are configured to be coupled to one another by moving the at least one alignment projection and the groove or notch of the lamella towards one another in a direction transverse to the longitudinal extension of the fixation element.

2. Lamella front surface system according to claim 1, wherein the interfacing structure of the first side of the fixation element comprises the at least one first projecting leg projecting from the body of the fixation element, the at least one first projecting leg being configured to connect with the attachment structure of the metal mounting element.

3. Lamella front surface system according to claim 2, wherein an end part of the at least one first projection leg comprises an area of increased thickness.

4. Lamella front surface system according to claim 1, wherein the attachment structure is a number of slots arranged in the interfacing side, the slots being configured to receive the at least one first projecting leg.

5. Lamella front surface system according to claim 3, wherein the end part of the at least one first projecting leg and a slot of the attachment structure constitute a snap-lock arrangement.

6. Lamella front surface system according to claim 2, wherein the first side of the fixation element comprises a second projecting leg having an end part, the end part of the second projecting leg being in a substantially perpendicular position configured to be lockingly engaged with the attachment structure of the metal mounting element.

7. Lamella front surface system according to claim 2, wherein when inserting the end part of the at least one first projection leg from a position in which the at least one first projecting leg, and thereby the fixation element as a whole, is tilted by more than 5° and less than 80° from perpendicular to the mounting element, the end part of the at least one first projecting leg of the fixation element can be inserted into the attachment structure of the mounting element substantially without touching each other, and upon tilting to a position different from approximately 5°-80°, they are arranged to be lockingly engaged.

8. Lamella front surface system according to claim 1, wherein the first projecting leg has a first extension and a second projecting leg has a second extension, the first and second extensions being 5-100 mm.

9. Lamella front surface system according to claim 1, wherein the lamella is affixed to the fixation element by screws.

10. Lamella front surface system according to claim 9, wherein the body of the fixation element comprises apertures, the apertures being 2-20 mm, and wherein a number of the apertures are elongated apertures.

11. Use of the lamella front surface system according to claim 1 for at least partially covering a structure such as a building or a part of a building.

12. Lamella front surface system according to claim 1, wherein the at least one alignment projection includes two alignment projections received within respective grooves or notches of the lamella.

13. Lamella front surface system, comprising:

at least one lamella having a length, at least two metal mounting elements each having a mounting axis, configured to be attached to a support face of a building, each of the metal mounting elements comprising:

a mounting side abutting the face in its mounted position, an interfacing side arranged opposite the mounting side, the interfacing side comprising attachment structure, wherein the lamella front surface system further comprises:

a fixation element extending substantially the entire length of the lamella, the fixation element having a longitudinal extension and having:

a body having a first side comprising interfacing structure configured to be connected with the attachment structure, and a second side configured to support the lamella in a position which is substantially perpendicular to the mounting axis of the metal mounting elements, wherein the lamella is made from a non-metal material, and wherein the fixation element comprises at least one alignment projection extending from the side of the body opposite the side from which the at least one first projecting leg extends, the at least one alignment projection being received within a groove or notch of the lamella, and wherein the lamella front surface system further comprises a fixation bracket for each of the mounting elements, each fixation bracket including cut outs to lock with the mounting element.

14. Lamella front surface system according to claim 13, wherein each said fixation bracket includes a hole or slot to receive a screw to secure the fixation element.

15. Lamella front surface system according to claim 13, wherein each said fixation bracket is configured to be inserted within the mounting element, and then rotated so that projections of the mounting element engage with cut outs of the fixation bracket with the fixation bracket positioned above the fixation element.

16. Lamella front surface system according to claim 1, further comprising at least one fixation bracket anchored to a selected one of the mounting elements, the at least one fixation bracket being configured to secure the fixation element in position relative to the selected mounting element.

* * * * *